US007111395B2

(12) United States Patent
Sandner

(10) Patent No.: US 7,111,395 B2
(45) Date of Patent: Sep. 26, 2006

(54) METHOD FOR DENSIFYING TEETH OF A GEAR WHEEL

(75) Inventor: Christian Sandner, Gmunden (AT)

(73) Assignee: Miba Sintermetall GmbH, Laakirchen (AT)

( * ) Notice: Subject to any disclaimer, the term of this patent is extended or adjusted under 35 U.S.C. 154(b) by 400 days.

(21) Appl. No.: 10/416,598

(22) PCT Filed: Nov. 28, 2001

(86) PCT No.: PCT/AT01/00374

§ 371 (c)(1),
(2), (4) Date: May 13, 2003

(87) PCT Pub. No.: WO02/43897

PCT Pub. Date: Jun. 6, 2002

(65) Prior Publication Data

US 2004/0016123 A1 Jan. 29, 2004

(30) Foreign Application Priority Data

Nov. 30, 2000 (AT) ..... A 2012/2000

(51) Int. Cl.
*B21K 1/30* (2006.01)
*B23P 15/14* (2006.01)

(52) U.S. Cl. ..... 29/893.3; 29/893.34; 29/893.36; 29/893.37; 74/457

(58) Field of Classification Search ..... 29/893, 29/893.3, 893.34, 893.36, 893.37; 74/457–462
See application file for complete search history.

(56) References Cited

U.S. PATENT DOCUMENTS

| | | | | |
|---|---|---|---|---|
| 4,106,361 | A * | 8/1978 | Burtis | 74/462 |
| 4,111,031 | A * | 9/1978 | Vennemeyer et al. | 72/359 |
| 6,044,555 | A * | 4/2000 | Jacob et al. | 29/893.34 |
| 6,168,754 | B1 * | 1/2001 | Woolf et al. | 419/28 |

FOREIGN PATENT DOCUMENTS

| | | | |
|---|---|---|---|
| JP | 10176203 | | 6/1998 |
| JP | 10176203 | A * | 6/1998 |
| WO | 9205897 | | 4/1992 |
| WO | 0043148 | | 7/2000 |

* cited by examiner

*Primary Examiner*—David P. Bryant
*Assistant Examiner*—Sarang Afzali
(74) *Attorney, Agent, or Firm*—Collard & Roe, P.C.

(57) ABSTRACT

A method and an apparatus are described for producing a gear wheel from a powder metal blank (1) which is sintered and pressed with an overmeasure in the flank and root region of the teeth and which in the region of the overmeasure is densified under plastic deformation by the overmeasure by pressing in a counter-toothing (3) of a pressing tool (2) which engages in the toothing (4). In order to provide advantageous conditions it is proposed that during the plastic deformation of the flank or foot region of the tooth, the tip surface of the respective tooth is subjected to a pressure force counteracting an extension of the tooth.

1 Claim, 1 Drawing Sheet

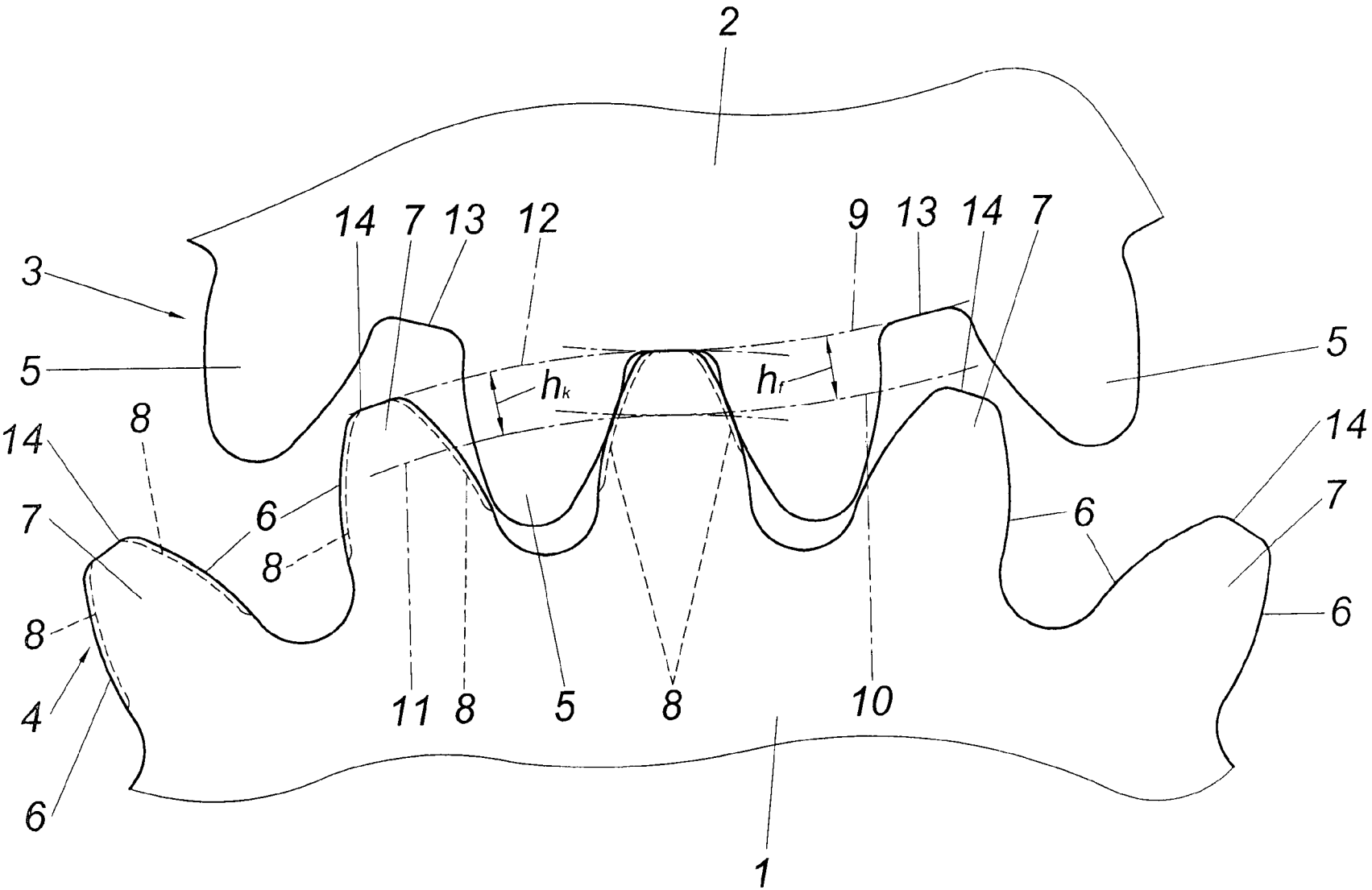
1
2
3
4
5
6
7
8
9
10
11
12
13
14
$h_f$
$h_k$

METHOD FOR DENSIFYING TEETH OF A GEAR WHEEL

CROSS REFERENCE TO RELATED APPLICATIONS

Applicants claim priority under 35 U.S.C. §119 of AUSTRIA Application No. A 2012/2000 filed on 30 Nov. 2000. Applicants also claim priority under 35 U.S.C. §365 of PCT/AT01/00374 filed on 28 Nov. 2001. The international application under PCT article 21(2) was not published in English.

TECHNICAL FIELD

The invention relates to a method for producing a gear wheel from a powder metal blank which is sintered and pressed with overmeasure in the flank and root region of the teeth and which in the region of the overmeasure is densified under plastic deformation by the overmeasure by pressing a counter-toothing of a pressing tool which engages in the toothing.

RELATED ART

Since the densification of a molded body which is pressed from a sintering powder is limited by the loading capacity of the pressing tools, one must expect a residual porosity in said molded bodies. Said residual porosity from gear wheels sintered and pressed from a sintering powder impairs the loading capacity of the teeth. In order to improve the thus caused lower bending stress fatigue limit in the region of the roots of the teeth and the lower capacity of resistance to wear in the region of the tooth flanks, it is known (EP 0 552 272 B1, WO 00/43148 A1) to compress the sintered powder metal blanks of the gear wheels in the flank and root region of the teeth, so that a substantially pore-free surface layer is obtained. For this purpose a pressing tool in the form of at least one gear wheel is inserted which comprises a counter-toothing engaging in the toothing of the powder metal blank. The teeth of the powder metal blank are thus subject in the region of engagement of the pressing tool to a redensification, namely to the extent of the overmeasure of the powder metal blank provided in the region of the flank or root.

Although in the case of a conventional tooth load the tension peaks occur in the regions close to the surface and consequently a comparatively low redensification in the flank and root region leads to a considerable increase in the carrying capacity of the toothing, the carrying capacity of the toothing can be increased with the thickness of the redensified surface layer. Since the depth of the redensification depends primarily on the amount of the overmeasure in the flank and root region of the toothing, an increase in the carrying capacity of the toothing requires increasing overmeasures which not only allow the desired deeper densification of the flank and root region, but also give rise to an extension of the tooth in the direction of the height of the tooth, especially during the loading on both sides of the tooth flank of the powder metal blank by the counter-toothing of the pressing tool. The tensile stresses in the tooth body produced by the extension of the tooth lead to the likelihood of the formation of cracks, which may lead to tooth breakages. This means that the depth of the redensification and thus the possible increase in the carrying capacity of the teeth must remain limited.

In order to achieve an even surface densification with simultaneous shaping it is further known (JP 10176203A) to exert, with the help of a counter-toothing, a uniform pressure load on the teeth of a sintered gear wheel during the rolling-off process. Since no formation of cracks are to be expected in the tooth body in such a shaping densification of a comparatively low extent, such a shaping densification rolling cannot provide any teachings as to how the inclination towards cracks can be suppressed in the case of locally limited, comparatively large densifications.

DESCRIPTION OF THE INVENTION

The invention is thus based on the object of providing a method for producing a gear wheel of the kind mentioned above in such a way that the carrying capacity of the toothing can be increased without having to fear any formations of cracks in the tooth body.

This object is achieved by the invention in such a way that during the plastic deformation of the flank or root region, the tip surface of the respective tooth is subjected to a pressure force counteracting the extension of the tooth.

The pressure force acting during the plastic deformation of the flank or root region on the tip surfaces of the teeth counteracts a flow of the sinter material in the direction of the tip of the tooth due to the plastic deformation of the flank or root region, so that the tensile stresses occurring during the free flowing of the sinter material can be suppressed to a substantial extent, namely in conjunction with an additional slight densification of the tip of the tooth. This creates the necessary preconditions for increasing the thickness of the densified surface layers in the flank or root region by increasing the overmeasure of the powder metal blank without impairing the endurance of the tooth body per se. Notice must be taken in this connection that as a result of a substantial suppression of the flow movement of the sinter material in the direction of the height of the tooth the densification is supported in the flank or root region.

For the purpose of producing sintered gear wheels in accordance with the invention with redensified flank or root regions of the teeth, one can start out from a known apparatus with a receiving shaft for a powder metal blank and a pressing tool with a counter-toothing engaging in the toothing of the powder metal blank. In such an apparatus it is merely necessary that the addendum of the toothing of the powder metal blank corresponds to the dedendum of the counter-toothing of the pressing tool in order to suppress any radial extension of the teeth of the powder metal blank during the redensification of the flank or root regions. Due to the lack of clearance, the gap profile between the tooth flanks of the counter-toothing of the pressing tool determines the shape of the tip surface of the teeth of the powder metal blank, so that through this gap profile it is additionally possible to predetermine a desired course of the tip surface of the teeth of the gear wheel, which thus renders superfluous the usually required aftertreatment of the tip surfaces of the teeth. The flow of the sinter material in the radial direction which is caused by the redensification of the tooth flanks of the powder metal blank is obstructed by the gap profile of the pressing tool, with the gap profile acting in a shaping manner for the tip surface of the teeth.

BRIEF DESCRIPTION OF THE DRAWINGS

The method in accordance with the invention for producing a gear wheel is now explained in more detail by reference to the drawing which shows an axial sectional view in the region of the tool engagement of a powder metal blank which combs a pressing tool in accordance with the invention.

EMBODIMENTS OF THE INVENTION

The powder metal blank 1 which is pressed and sintered with a respective overmeasure in the tooth flank region is clamped on receiving shaft and machined with the help of a pressing tool 2 which comprises a gear rim with a counter-toothing 3 for the toothing 4 of the powder metal blank 1. The tooth geometry of the counter-toothing 3 is set to the desired geometry of toothing 4 of the gear wheel to be produced. Since the powder metal blank 1 comprises an overmeasure in the region of the tooth flanks 6 of its teeth 7, this means that during the rolling off of the pressing tool 2 on the powder metal blank 1 the tooth flanks 6 of toothing 4 of the powder metal blank 1 are deformed plastically by the overmeasure to the desired progress by the teeth 5 of the counter-toothing 3 of the pressing tool 2, namely under a redensification of a surface layer 8 which is indicated in the drawing with the broken line.

As a result of the pressure load of the tooth flanks 6 of teeth 7 by the teeth 5 of the counter-toothing 3, the teeth 7 of the powder metal blank 1 have a tendency towards a radial extension especially in the case of a flank load on both sides by the pressing tool 2, leading to tensile stresses within the tooth body. In order to limit the extension and thus the tensile stress, the dedendum $h_f$ of the teeth 5 of the pressing tool 2 as measured between the dedendum circle 9 and the pitch circle 10 of the counter-toothing 3 corresponds to the addendum $h_k$ of the teeth 7 of the toothing 4 of the powder metal blank 1 as measured between the pitch circle 11 and the addendum circle 12. As a result of this simple measure, a pressure force is exerted upon the tip surface 14 of teeth 7 of the powder metal blank 1 via the gap profile 13 between the flanks of the teeth 5 of the counter-toothing 3 with the effect that the extension is suppressed and the tip surface 14 of the teeth is forced to assume a shape predetermined by the gap profile 13. As a consequence of the suppression of the radial extensions of the teeth 7 of the powder metal blank 1, the tensile stresses which occur otherwise by a radial flowing of the sinter material in the region of the tooth body can be suppressed to a large extent, leading to a higher depth of the densified surface layers 8 in the tooth flank region. Moreover, an additional densification of the tip of the tooth is obtained.

The invention claimed is:

1. A method for producing a gear wheel from a powder metal blank (1) which is sintered and pressed with an overmeasure in the flank and root region of the teeth and which in the region of the overmeasure is densified under plastic deformation by the overmeasure by pressing in a counter-toothing (3) of a pressing tool (2) which engages in the toothing (4), characterized in that during the plastic deformation of the flank or root region the tip surface of the respective tooth is subjected to a pressure force counteracting the extension of the tooth.

* * * * *